US006059582A

United States Patent [19]

Tsai

[11] Patent Number: 6,059,582

[45] Date of Patent: May 9, 2000

[54] ADAPTOR BOX FOR MOUNTING FIXTURE TO LOW VOLTAGE TRACK

[75] Inventor: Meng-Feng Tsai, Bethpage, N.Y.

[73] Assignee: W.A.C. Lighting, New York, N.Y.

[21] Appl. No.: 09/119,207

[22] Filed: Jul. 20, 1998

[51] Int. Cl.[7] ..... H01R 25/00

[52] U.S. Cl. ..... 439/121; 439/110; 362/287

[58] Field of Search ..... 439/110, 111, 439/112, 114, 117, 119, 120–2, 532, 529–1; 362/286–287

[56] References Cited

U.S. PATENT DOCUMENTS

| | | | |
|---|---|---|---|
| 4,108,523 | 8/1978 | Bolis . | |
| 4,699,439 | 10/1987 | Cohen | 439/207 |
| 4,919,625 | 4/1990 | Coutre | 439/118 |
| 5,334,037 | 8/1994 | Gabrius | 439/118 |

*Primary Examiner*—Lincoln Donovan
*Attorney, Agent, or Firm*—Robert W. J. Usher

[57] ABSTRACT

An adaptor box for mounting a fixture to a low voltage lighting track having a channel-form cavity retaining wire busses has a one piece, molded housing with opposite side walls joined by upper, lower and rear walls providing a front opening cavity. A mounting head upstands from the upper wall and is formed with opposed mounting ears. A contact receiving through-passageway having a front, contact insertion opening extends from the housing cavity, vertically through the mounting head between the ears, the upper wall being recessed so that the housing is open at a front and at a top, adjacent the front. A one-piece molded insert has a contact separating rib and a releasable, rotation preventing latching tab portion connected together by a transverse, resilient web hinge. A pair of contacts terminating fixture wires extend through the passageway with free ends exposed for electrical connection to the busses. The housing and the insert snap fit together by receipt of the contact separating rib in the through-passageway, between the contacts, with the latching tab closing the front opening and the resilient web hinge extending across the rebate. The latching tab has an upper catch portion which, in an undeformed position of the web hinge, protrudes above the upper wall of the housing in a rotation preventing position and a lower fingerpiece, depressible to resilient deform the web hinge and withdraw the catch portion toward the upper wall to a release position permitting rotation of the mounting head within the track cavity.

10 Claims, 6 Drawing Sheets

ADAPTOR BOX FOR MOUNTING FIXTURE TO LOW VOLTAGE TRACK

FIELD OF THE INVENTION

The invention relates to an adaptor box for mounting a low voltage lighting fixture to a low voltage track.

BACKGROUND OF THE INVENTION

Adaptor boxes are used for mounting low voltage lighting fixtures to a low voltage track. As well recognized, such adaptor boxes must not only provide reliable mechanical support for the lighting fixture but also reliable electrical connection. As such fixtures typically operate on only 12 volts, even a small voltage drop at the connection to the track may result in a discernable effect on the operation of the light fixture.

At the same time the adaptor boxes should be of desirably small size with few parts, affording economic manufacture and assembly at high volume.

A conventional type of low voltage lighting track has an insulating body formed by an elongate web joining conventional flanges, from respective free ends of which protrude inward mounting edge portions or lips defining a generally channel form cavity for receiving a mounting head portion of the adapter box. Conventional conductive wire busses are mounted on respective ears adjacent the junction of the flanges and the web.

A conventional type of adaptor box assembly comprises a contact housing assembly having a mounting head for mounting in the cavity by opposed ears thereof engaging over respective lips, separated contacts terminating fixture wires in the housing assembly and extending through an opening or passageway in the head for connection to respective track wires; a wire guide assembly, and a releasable latching member extending between the lips to prevent accidental rotation of the head which would disengage the ears, demounting the adaptor box from the track.

A widely used adaptor box of the type described above is disclosed in U.S. Pat. No. 5,334,037 issued Aug. 2, 1994 to Gabrius et al., the disclosure of which is incorporated herein by reference. The reference teaches that adaptor box housing should be formed by two, separately molded, housing halves, subsequently assembled with their open faces abutted together, and secured by a screw passing through both housing halves. A contact separator is molded in one piece in the contact opening or passageway of one housing half, permitting the contacts to be preassembled in the housing in separated positions by insertion through the open face, to extend through the contact opening on opposite sides of the contact separator, and the housing halves subsequently secured together. The rotation preventing latch is also a separately molded element subsequently mounted on one of the housing halves. A wire guide assembly comprises several components which are secured together by a rivet and require access provided by an open face for preassembly in the housing half.

Thus, the prior adaptor box consists of many different parts which require separate manufacture and several assembly steps while the integrity of the overall structure depends on the effectiveness of a single screw fastening between plastic housing halves.

SUMMARY OF THE INVENTION

It is an object of the invention to provide an adaptor box which is manufactured and assembled from relatively few parts which are adapted for easy and rapid assembly.

Another object of the invention is to provide an adaptor box which has good rigidity and integrity which is maintained over time providing and reliably good mechanical support.

According to one aspect, the invention provides an adaptor box comprising a housing molded in one piece of insulating plastic material and comprising opposite side walls joined by upper, lower and rear walls providing a cavity open at a front, a mounting head upstanding integrally from the upper wall and formed with opposed mounting ears and a contact receiving through-passageway having a front, contact insertion opening, extending from the housing cavity vertically through the mounting head between the ears, the upper wall being rebated from the front opening to the contact insertion opening so that the housing is open at a front and at a top, from the front to the contact insertion opening; an insert molded in one piece of insulating plastic material comprising a contact separating rib and a releasable, rotation preventing latching tab portion connected together to extend in generally parallel relation, one above the other, by a transverse, resilient web hinge; a pair of contacts extending through the passageway each having one end terminating a respective fixture wire and another end exposed for electrical connection to respective track wires; means for attaching a low voltage lighting fixture to the housing, and the housing and the insert having resilient latching means cooperable to assemble the housing and insert together in a snap fit, the insert being assembled with the housing by receipt of the contact separating rib in the through-passageway, between the contacts, with the latching tab extending across the front opening and the resilient web hinge extending across the rebate, the latching tab having an upper catch portion which, in an undeformed position of the web hinge, protrudes above the upper wall of the housing in a rotation preventing position and a lower fingerpiece, depressible to resilient deform the web hinge and withdraw the catch portion toward the upper wall to a release position permitting rotation of the mounting head within the track cavity.

As the housing is substantially fully formed as a single injection molded piece being only open at a front and with a small rebate in the upper wall, it is desirably rigid, providing good mechanical support for the fixture and, with the insert assembled, retaining the contacts in reliably good electrical connection with the track wires.

Assembling the insert with the housing requires only a relatively simple step while reliance on retaining engagement between a screw thread and a plastic part is avoided. Furthermore, significantly fewer different parts are required with the insert being assembled with the housing by a relatively easy snap action.

Preferably, the contact insertion opening is a slot of less width than the passageway and the contact separating rib is formed with longitudinally extending, rib locating flanges on opposite side thereof which are received in the passageway in sliding engagement behind respective opposite edge portions of the slot to prevent the rib from forward movement out from the passageway and the rib is formed with a head portion located forward of the flanges and received in the slot as a sliding fit. These features afford added stability.

A partitioning tab of reduced thickness may extend centrally from a lower end of the rib to ensure separation of the contacts In a more particular, desirable construction, the insert comprises a right angled locating frame having upper and lower U-form, sub frame portions respectively, comprising respective pairs of parallel arms joined by respective transverse arms, free ends of respective arms of the upper sub frame portion being integrally joined to corresponding free ends of arms of the lower sub frame portion so that the respective U-form sub frame portions extend in orthogonal planes, the transverse arm of the upper sub frame joining a front surface of the head portion of the rib adjacent a lower end thereof and the web hinge being mounted to the transverse arm of the upper sub frame so as to locate the fingerpiece of the latching tab in the lower sub frame, protruding forwardly thereof in the undeformed position of the web hinge and the upper catch portion protruding upwards out of the plane of the top of the upper sub frame, in the undeformed position of the hinge, with the upper and lower sub frames being assembled with the housing extending across the rebate, flush with the upper wall, and across the front opening, respectively, substantially closing the housing cavity, depression of the fingerpiece rearward into the lower sub frame pivoting the catch portion downward about the web hinge to the plane of the upper sub frame and upper wall into a release position. It is also preferred that the fingerpiece progressively increases in thickness toward a lower end of the latching tab so that it protrudes forwards out of the plane of the front of the lower sub frame.

These features provide an unobtrusive but effective housing closure and latching mechanism.

Suitably, the latching means comprise complementary indents and detents formed on upper edge portions of the side walls at the rebate and on the arms of the upper sub frame, respectively.

BRIEF INTRODUCTION TO THE DRAWINGS

In order that the invention may be readily understood, a specific embodiment thereof will now be described with reference to the accompanying drawings in which.

DESCRIPTION OF PARTICULAR EMBODIMENT

Figure 1:
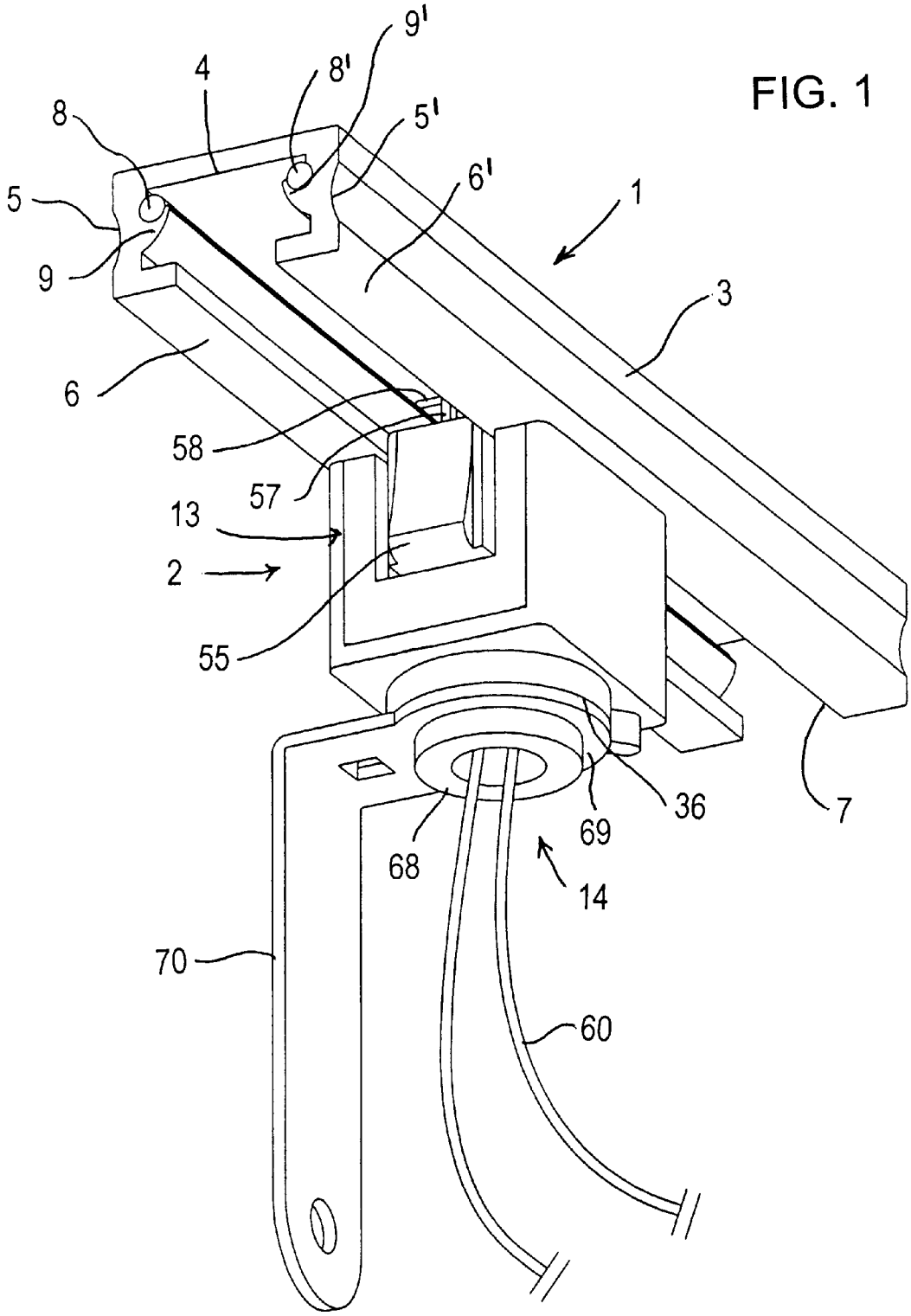
FIG. 1 is a perspective view of an adaptor box according to the invention mounted on a low voltage track.
Figure 2:
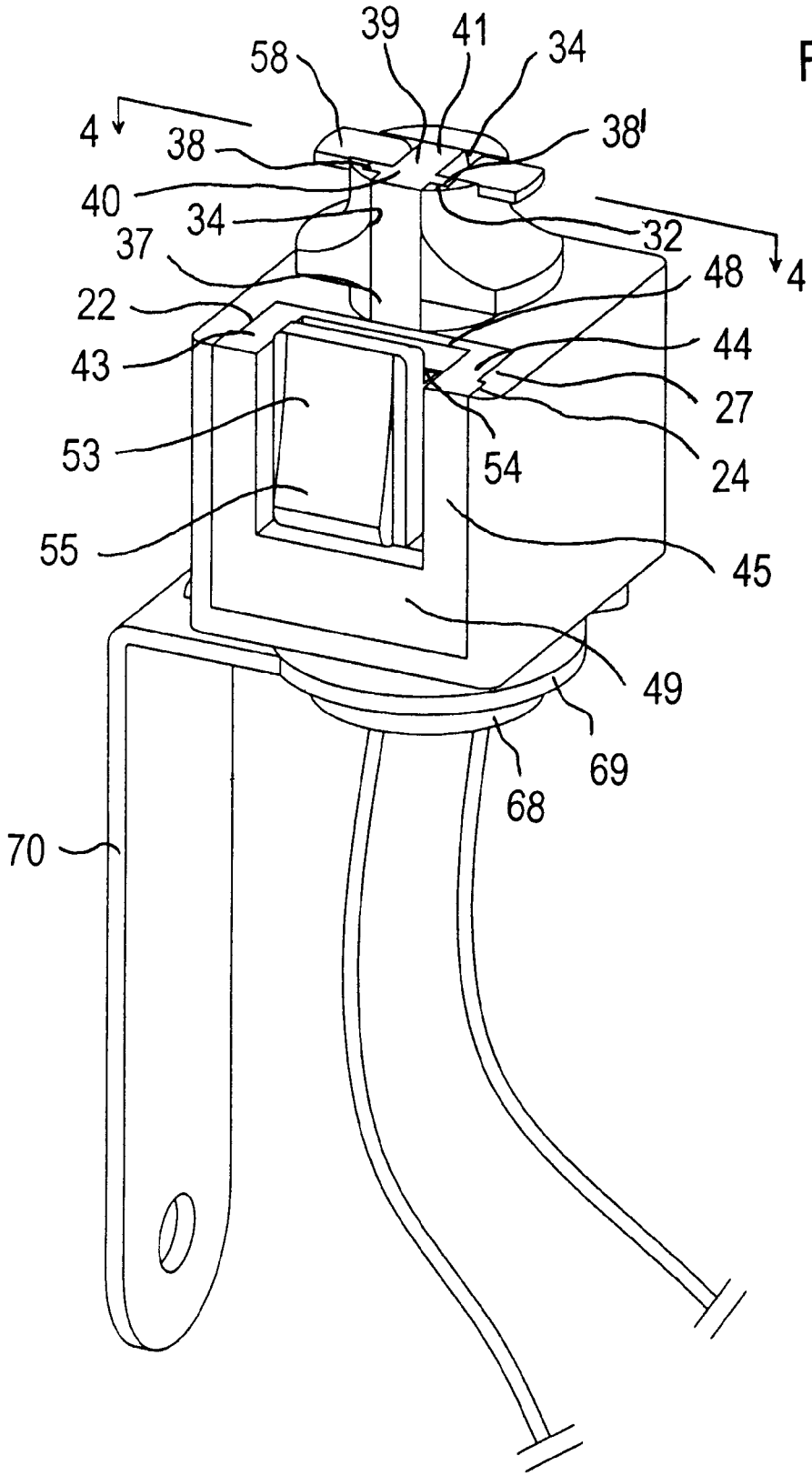
FIG. 2 is a perspective view of the adaptor box removed from the low voltage track.
Figure 5:
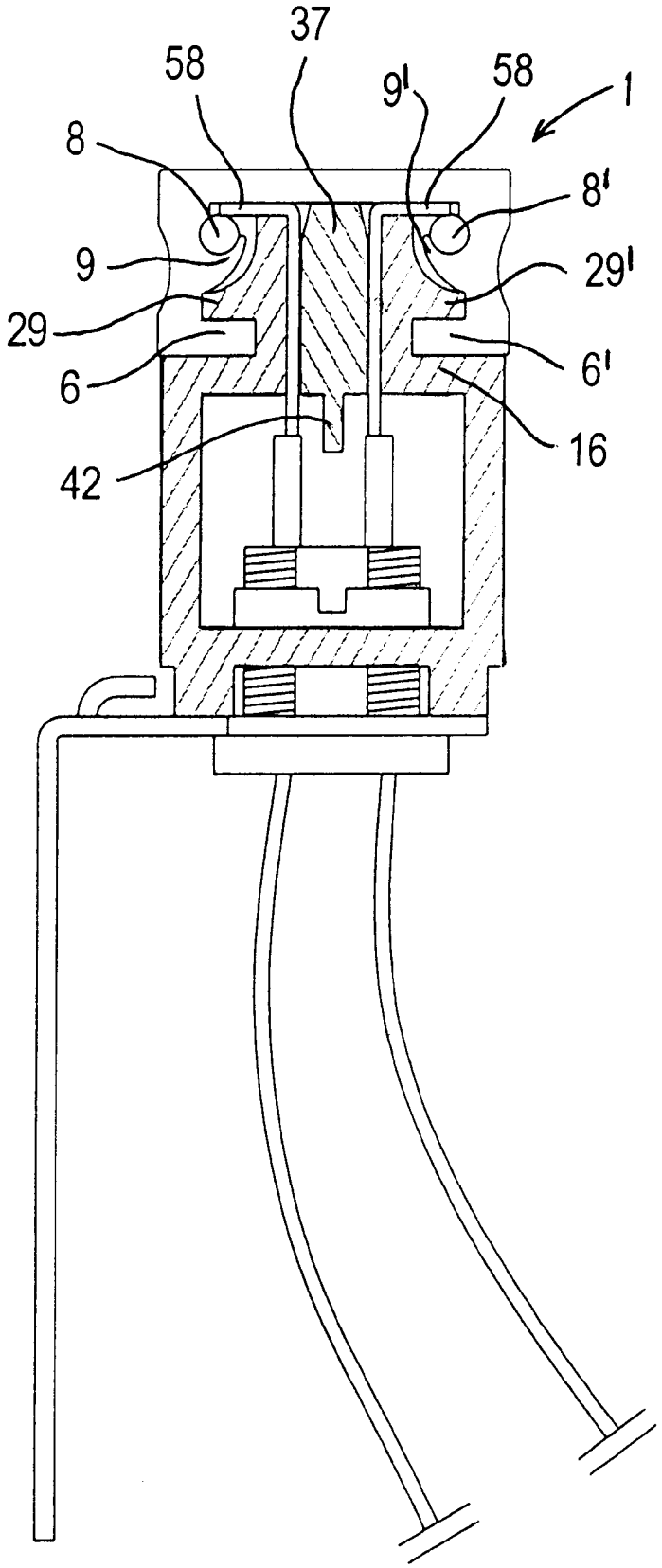
FIG. 5 is a similar view to FIG. 4 but showing the adaptor box mounted in a low voltage track.

As shown in FIGS. 1 and 5, a conventional low voltage lighting track 1 has the specific embodiment of adaptor box 2 mounted thereon.

The lighting track 1 has an extruded insulating plastic body 3 with an elongate web 4 joining conventional flanges 5,5', from respective free ends of which protrude inward mounting edge portions or lips 6,6' defining a generally channel form cavity 7 for receiving a mounting head portion of an adapter box 2. Conventional conductive wire busses 8,8' are mounted on respective ears 9,9'.

The adaptor box 2 comprises a housing 12 receiving an insert 13 forming a combined contact separator and anti-rotation member, a pair of electrical contacts 14 terminating respective wires, and a wire guide assembly 15.

Figure 3:
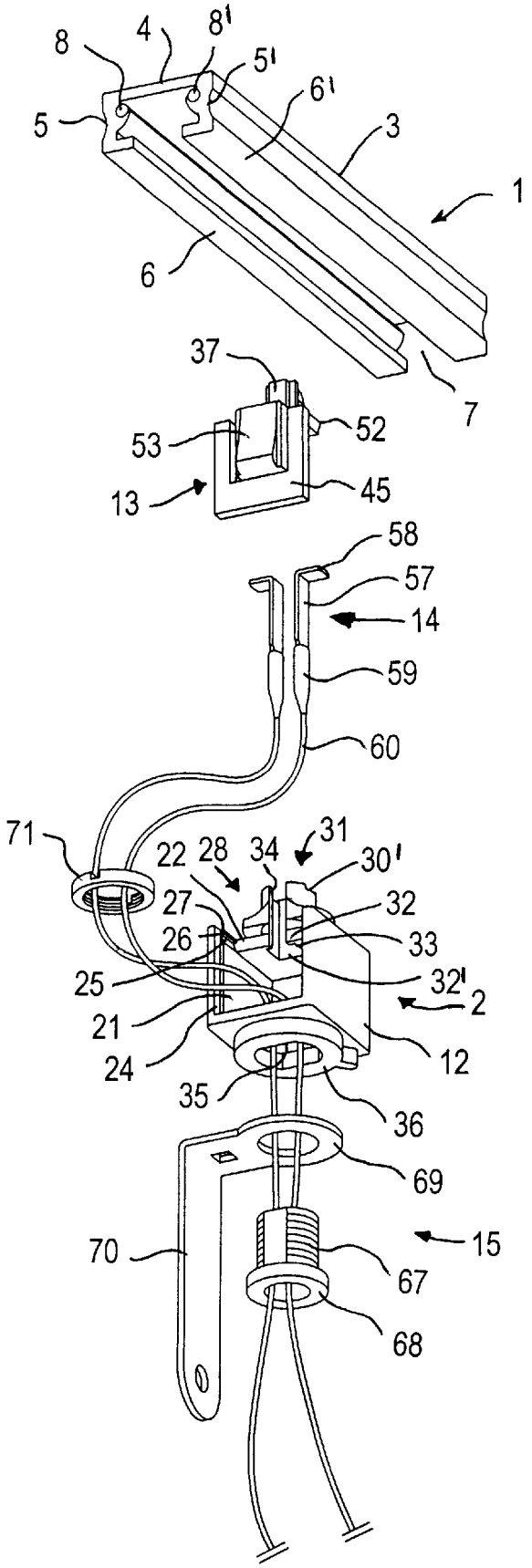
FIG. 3 is an exploded perspective view of the adaptor box and low voltage track.
Figure 4:
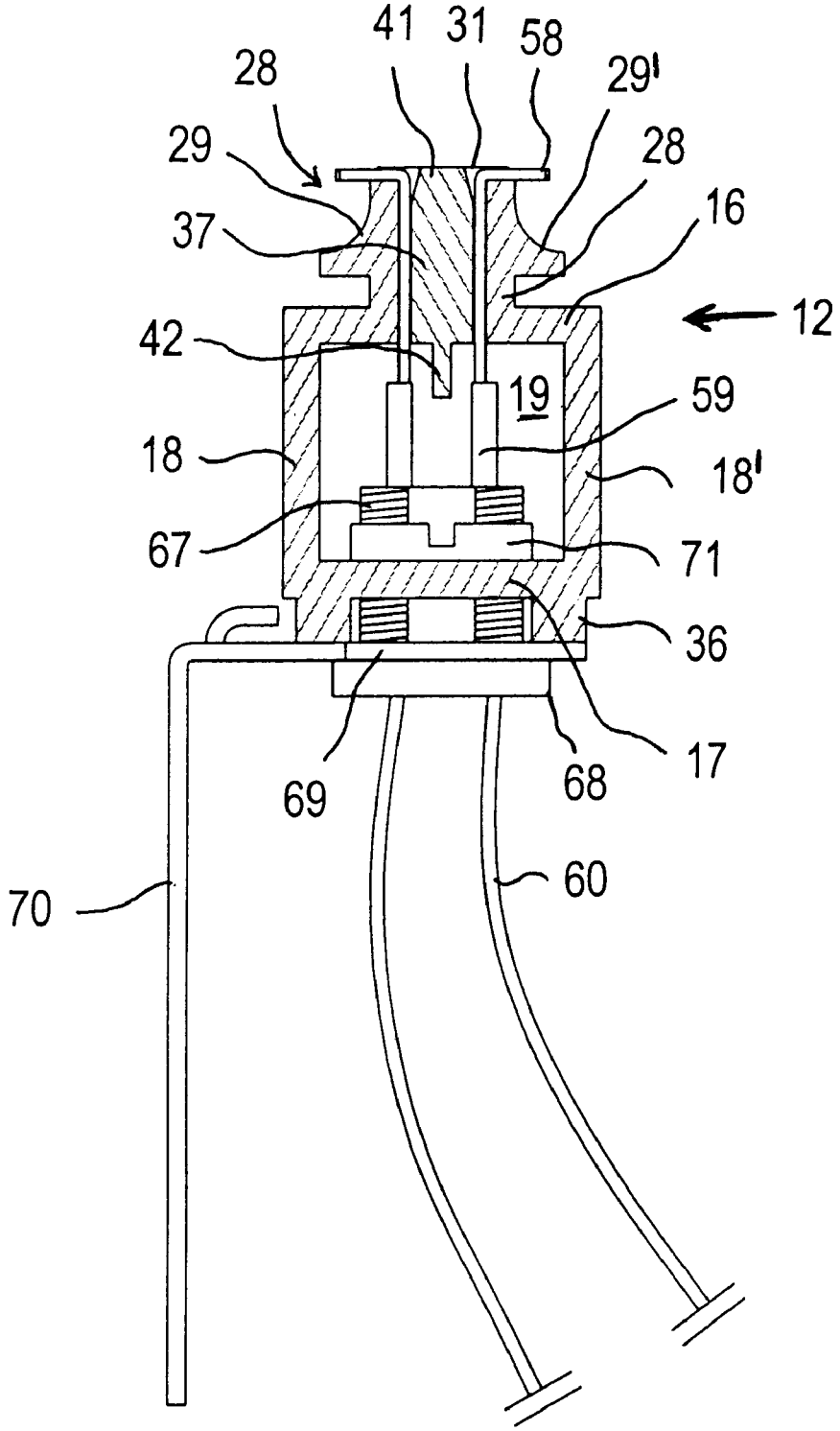
FIG. 4 is a cross-sectional view in a medial plane of the adaptor box, along line 4—4 of FIG. 2.

As best seen in FIGS. 3 and 4, the housing 12 is injection molded in one piece from suitable insulating plastic material as a hollow rectanguloid body having upper and lower walls 16,17, respectively; opposite side walls 18,18' and a rear wall 19. The housing has a front opening 21 which is continuous with a rebate 22 which extends rearwardly in the upper wall 16 for approximately one third the front to rear depth thereof providing access to the interior.

Forward edge portions of the lower and opposite side walls 17 and 18,18', respectively, are of reduced thickness or stepped around the front opening to provide an insert locating recess or seat 24 which extends to the upper face. Upper portions of opposite side walls 18,18' adjacent the upper face are of progressively reduced thickness, having upwardly divergent, inner surfaces 25 forming latching grooves 26 terminating at the upper face in inwardly protruding latching lips 27 and extending rearward to a front edge of the upper wall.

A mounting head 28 upstands from a forward portion of the upper wall 16, centrally of the box, and is formed with a pair of opposed, track mounting ears 29, 29', protruding from opposite sides thereof. Upwardly opening, contact receiving recesses 30, 30' are formed on opposite sides of the top of the head aligned centrally above respective ears. The mounting head is formed with a central, vertically extending contact receiving passageway 31 of generally rectangular cross-section having front, rear and opposite side walls, 32,32' and 33, respectively, with a contact insertion slot 34 extending axially vertically in the front wall 31 for the entire height thereof.

The bottom wall 17 is formed, at a central location, with an eccentric, wire receiving opening 35 surrounded by an annular lip 36 which protrudes from a lower face.

The insert 13 is injection molded in one piece from the same plastic material as the housing and comprises a contact separating rib portion 37 of T cross-section having opposed, locating flanges or arms 38,38' extending from respective opposite sides of a stem 39 so as to define a forward head portion 40 from which extends a body portion 41 which tapers adjacent a top. A partitioning tab 42 of reduced thickness extends centrally from a lower end of the rib 37.

The anti-rotation portion 43 comprises a right angled, locating frame-like portion having upper and lower U-form sub frame portions 44 and 45, respectively, comprising respective pairs of parallel arms 46, 46' and 47, 47', respectively, joined by respective transverse arms 48 and 49. Free ends of respective arms 46, 46' are integrally joined to corresponding free ends of arms 47, 47' so that the respective U-form sub frame portions 44 and 45 extend in orthogonal planes. Latching detents 48, 51' having lead in ramp surfaces 49,49' complementary to surfaces 25 are formed on arms 46,46', respectively. Arm 48 joins a front surface of the head portion 40 adjacent a lower end thereof. A latching tab 53 is mounted to a lower face of the arm 48 by a loop-section resilient web hinge 54 so as to lie within the lower sub frame 45 in general coplanar relation therewith and progressively increases in thickness toward a lower portion forming a button or fingerpiece 55 which, in a normal, undeformed position of the hinge 54, protrudes forwards out of the plane of the front of the lower sub frame 45, and an uppermost catch portion 56 which protrudes upwards out of the plane of the top of the upper sub frame 44.

The contacts 14 are stamped and formed metal parts with rigid leaf portions 57 each formed at a free end with a transverse contact foot 58 and rigidly connected by soldering at 59 to a respective wire 60. An insulating sleeve covers the soldered joint.

The wire guide assembly 15 comprises an externally threaded metal bush 67 formed with a flanged head 68 on a lower axial end, an annular bracket 69 formed on an upper end of a metal fixture arm 70 and a locking ring 71.

In assembling the adaptor box, the free end of the bush 67 is inserted through the bracket 69 and bottom opening 35 into the box cavity 21 where it is secured by threaded engagement with the locking ring 71 so that the head 68 clamps the bracket firmly against the lip 36. Contacts 14, soldered (or crimped) to respective fixture wires 60, are preassembled with the housing by insertion through the lower end of the bush 67 and temporarily positioned in the opening 34 in spaced apart, side by side relation, adjacent respective opposite side walls 33 with the respective feet 58 extending away from each other, located in respective notches 30,30' on the top of the mounting head. Although the upper ends of the contacts may move together, in some embodiments the overall sizes of the soldered or crimped joints and insulation may be somewhat larger than illustrated so that their abutment together may advantageously assist in maintaining the contacts spaced apart in the preassembled condition. The insert 13 is then assembled with the box housing 2 by inserting the lower sub frame 45, transverse arm 49 leading, downwardly into the front opening with respective arms 43 received in the upper portions of the recess 24 and with the partitioning rib 42 received in the upper end of the passageway 31 and between the two contacts. Forceful, further insertion of the contact separating rib portion 37 axially downwards into the top of the passageway 31, causing the body portion 41 to drive the contacts further apart into engagement with respective sidewalls 33 until the detents 49,49' enter the respective locking grooves 26 and lock under respective lips 27 with a snap action. During insertion, the head portion 40 slides down the contact insertion slot 34 so that respective contacts are trapped between respective flanges 38,38'; side walls 33; body portion 41 and rear wall 31' locking the insert 13 on the housing. In the fully assembled position, the rebate 22 and front opening 21 of the housing are covered by the upper sub frame and hinge, and the lower sub frame and tab, respectively.

Figure 8:
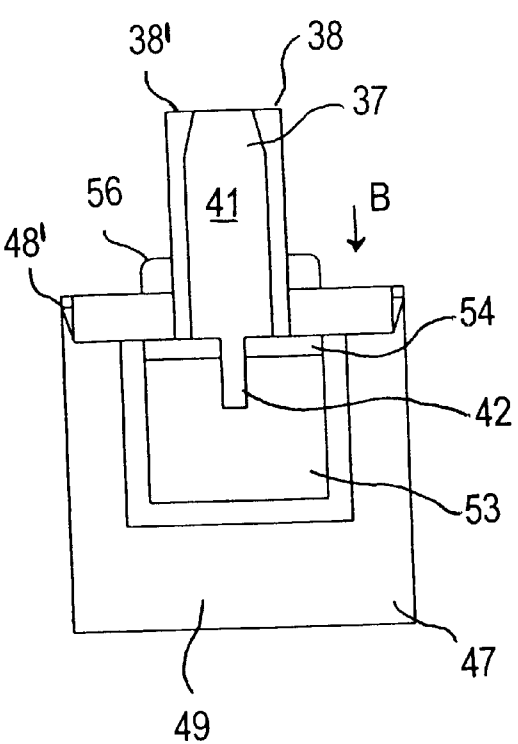
FIG. 8 is a rear elevational view of the insert.
Figure 7:
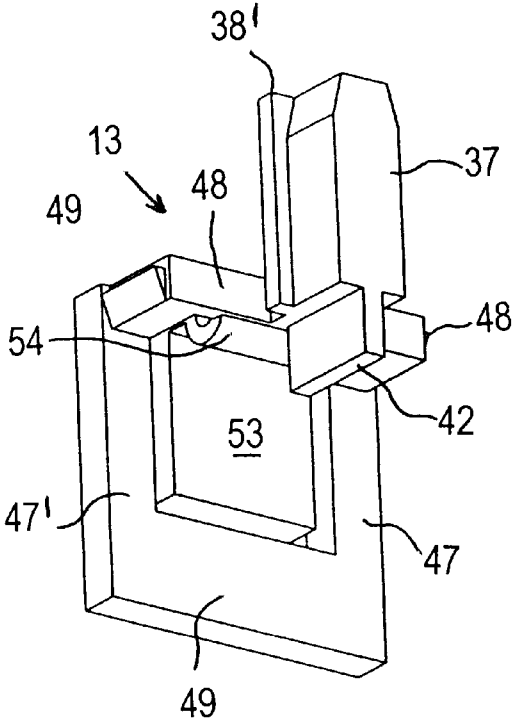
FIG. 7 is a perspective view of the insert taken from below one side.
Figure 6:
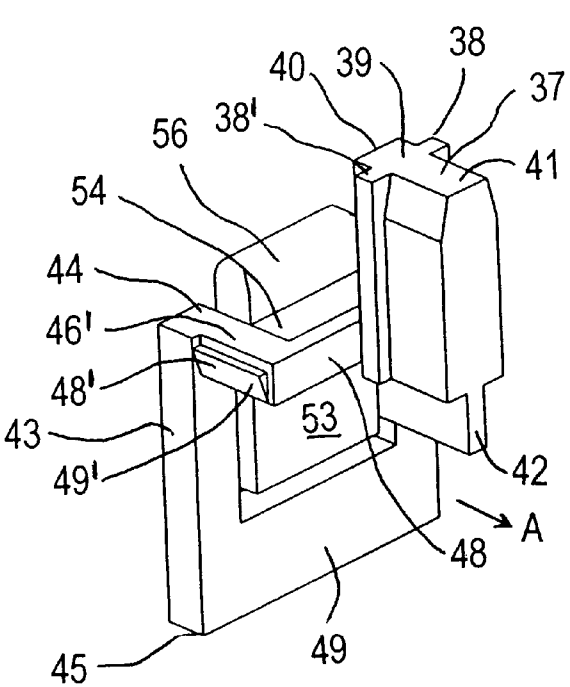
FIG. 6 is a perspective view of an insert taken from above and one side.

The assembled adaptor box can be mounted on the track by manual insertion of the mounting head into the cavity 7 with the ears 29, 29' aligned between the lips 6,6' and the catch portion 56 aligned with a lower surface of a lip 6 or 6'. In the normal position of the locking tab with the web hinge 54 undeformed, the top of the catch portion 56 will be brought into engagement with the lower surface of a lip preventing full insertion of the head into the cavity. Manual depression of the fingerpiece 55 (in the direction indicated by arrow A of FIG. 6) or upward pressure of the catch portion against the lower surface of the lip will withdraw or depress the catch portion 56 downwards (in the direction indicated by arrow B of FIG. 8), into the plane of the upper sub frame 44 permitting further upward insertion of the mounting head into the fully inserted position when it is turned through 90 degrees so that the contact feet 58 engage respective conductors 8,8' and ears 29, 29' engage over respective lips 6, 6' which are received between the ears and the upper wall 16 of the housing, as shown in FIG. 5. The resiliency of the web hinge 54 returns the catch portion 56 to the normal locking, rotation preventing position extending between lips 6'6' so that engagement with adjacent edges prevents rotation of the adaptor box.

Depression of the fingerpiece 55 back into the lower sub frame 45 pivots the latching tab 53 about the web hinge 54 withdrawing the catch portion 56 downwardly from between the lips 6, 6' into the plane of the upper sub frame 44 to permit rotation of the box through 90 degrees, disengaging the contacts from the busses and the ears 29, 29' from the upper surfaces of respective lips 6,6,' thereby permitting removal of the adaptor box from the track.

I claim:

1. An adaptor box for mounting a fixture to a low voltage lighting track comprising an insulating body formed by an elongate web joining flanges, having respective free ends from which mounting edge portions protrude inwards towards each other over the elongate web defining a channel section cavity for receiving a mounting head portion of the adapter box, ears located adjacent junctions of the flanges and the web and wire busses mounted on respective ears;

the adaptor box comprising a housing molded in one piece of insulating plastic material and comprising opposite side walls joined by upper, lower and rear walls providing a housing cavity having a front which is open, a mounting head integrally formed with the upper wall to upstand therefrom and formed with opposed mounting ears and a contact receiving through-passageway having a front, contact insertion opening, both the contact receiving through-passageway and the front, contact insertion opening extend from the housing cavity vertically through the mounting head between the mounting ears, the upper wall being formed with a recess extending from the front of the housing cavity which is open to the front, contact insertion opening so that the housing is open at a front and at a top, from the front to the front, contact insertion opening;

an insert molded in one piece of insulating plastic material comprising a contact separating rib and a releasable, rotation preventing latching tab portion connected together to extend in generally parallel relation, one above the other, by a transverse, resilient web hinge, a pair of contacts extending through the contact receiving through-passageway each having one end terminating a respective fixture wire and another end exposed for electrical connection to respective track busses, means for attaching a low voltage lighting fixture to the housing, and the housing and the insert having resilient latching means cooperable to assemble the housing and insert together in a snap fit, the insert being assembled with the housing by insertion of the contact separating rib through the front, contact insertion opening into the through-passageway, between the contacts, with the rotation preventing latching tab portion extending across the front of the housing cavity and the transverse, resilient web hinge extending across the recess, the rotation preventing latching tab comprising an upper catch portion which, in an undeformed position of the resilient web hinge, protrudes above the upper wall of the housing in a rotation preventing position preventing rotation of the housing relative to the channel section cavity of the track when the mounting head is received therein and a lower fingerpiece, depressible to deform the resilient web hinge and withdraw the upper catch portion toward the upper wall to a release position permitting rotation of the mounting head within the channel section cavity of the track to enable removal of the adaptor box therefrom.

2. An adaptor box according to claim 1, wherein the contact insertion opening is a slot having opposite elongate edge portions, the slot being of less width, as measured between the opposite elongate edge portions than a corresponding width of the contact-receiving through-passageway and the contact separating rib is formed with longitudinally extending, rib locating flanges on opposite side thereof which are received in the contact-receiving through-passageway in sliding engagement behind respective opposite edge portions of the slot to prevent the rib from forward movement out from the contact-receiving through-passageway.

3. An adaptor box according to claim 2, wherein the contact insertion opening is a slot having opposite elongate edge portions, the slot being of less width, as measured between the opposite elongate edge portions than a corresponding width of the contact-receiving through-passageway and the contact separating rib is formed with longitudinally extending, rib locating flanges on opposite side thereof which are received in the contact-receiving through-passageway in sliding engagement behind respective opposite edge portions of the slot to prevent forward movement of the rib out from the contact-receiving through-passageway.

4. An adaptor box according to claim 2, wherein the rib is formed with a head portion located forward of the flanges and received in the slot as a sliding fit.

5. An adaptor box according to claim 3, wherein the rib is formed with a head portion located forward of the flanges and received in the slot as a sliding fit.

6. An adaptor box according to claim 1, wherein a partitioning tab extends centrally from a lower end of the rib and is of less thickness than a corresponding thickness of the tab as measured in a width direction of the contact-receiving through-passageway.

7. An adaptor box according to claim 2, wherein a partitioning tab extends centrally from a lower end of the rib and is of less thickness than a corresponding thickness of the tab as measured in a width direction of the contact-receiving through-passageway.

8. An adaptor box according to claim 1, wherein the insert comprises a right angled locating frame comprising upper and lower U-form, sub frame portions respectively, comprising respective pairs of parallel arms integrally joined by respective transverse arms, free ends of respective arms of the upper sub frame portion being integrally joined to corresponding free ends of arms of the lower sub frame portion at right angles so that the respective U-form sub frame portions extend in orthogonal planes, the transverse arm of the upper sub frame joining a front surface of the head portion of the rib adjacent a lower end thereof and the web hinge being integrally joined to the transverse arm of the upper sub frame so as to locate the lower fingerpiece of the latching tab in the lower sub frame, protruding forwardly thereof in the undeformed position of the resilient web hinge and the upper catch portion protruding upwards out of the plane of the top of the upper sub frame, in the undeformed position of the resilient web hinge, with the upper and lower sub frames being assembled with the housing extending across the recess, flush with the upper wall, and across the front of the housing cavity, respectively, cooperating with the lower fingerpiece to close the housing cavity depression of the lower fingerpiece rearward into the lower sub frame pivoting the catch portion downward about the web hinge to the plane of the upper sub frame and upper wall into the release position.

9. An adaptor box according to claim 8, wherein the fingerpiece progressively increases in thickness toward a lower end of the latching tab so that it protrudes forwards out of the plane of the front of the lower sub frame.

10. An adaptor box according to claim 8, wherein the latching means comprise complementary indents and detents formed on upper edge portions of the side walls at the rebate and on the arms of the upper sub frame, respectively.

* * * * *